11/15/83 XR SR 4,415,206

United States Patent [19]

Hodges

[11] 4,415,206

[45] Nov. 15, 1983

[54] DRILL SECTION AND METHOD OF HYDRAULICALLY MINING MINERAL FORMATIONS

[76] Inventor: Everett L. Hodges, 49 Royal St. George, Newport Beach, Calif. 92660

[21] Appl. No.: 232,439

[22] Filed: Feb. 9, 1981

[51] Int. Cl.[3] ..... E21B 21/12

[52] U.S. Cl. ..... 299/17; 175/40; 175/65; 175/215; 175/320; 285/137 R

[58] Field of Search ..... 285/137 R, 137 A, 34 L, 285/355; 299/17, 5; 166/296; 175/40, 65, 215, 320

[56] References Cited

U.S. PATENT DOCUMENTS

| | | | |
|---|---|---|---|
| Re. 28,945 | 8/1976 | Miscovich | 299/17 |
| 469,841 | 3/1892 | McDougall . | |
| 842,364 | 1/1907 | White . | |
| 1,053,622 | 2/1913 | McAllister | 285/137 R |
| 1,059,626 | 4/1913 | McAllister | 285/137 R |
| 1,379,815 | 5/1921 | Hall . | |
| 1,759,490 | 5/1930 | Neveling . | |
| 1,909,075 | 5/1933 | Ricker et al. | 175/320 UX |
| 2,711,598 | 6/1955 | Craggs, Jr. . | |
| 3,155,177 | 11/1964 | Fly | 175/215 X |
| 3,472,558 | 10/1969 | Wittrowsky . | |
| 3,503,634 | 3/1970 | Cadiou | 285/137 R |
| 3,747,696 | 7/1973 | Wenneborg | 175/87 |
| 3,880,233 | 4/1975 | Muecke | 166/296 |
| 3,909,960 | 10/1975 | Casciano | 37/63 |
| 3,951,457 | 4/1976 | Redford | 299/5 |
| 4,018,283 | 4/1977 | Watkirl | 166/296 |
| 4,061,399 | 12/1977 | Nelson | 299/18 |
| 4,074,779 | 2/1978 | Cheung | 175/314 |
| 4,077,671 | 3/1978 | Bunnelle | 299/17 |
| 4,140,346 | 2/1979 | Barthel | 299/17 |

FOREIGN PATENT DOCUMENTS

| | | | |
|---|---|---|---|
| 755011 | 11/1933 | France | 175/314 |
| 54646 | 3/1967 | German Democratic Rep. . | |

*Primary Examiner*—William F. Pate, III
*Attorney, Agent, or Firm*—Hubbard & Stetina

[57] ABSTRACT

An improved drill section and method of hydraulically mining mineral deposits which includes plural flow conduits extending through the drill section, having complimentary shaped tapered thread sections at opposite ends thereof, is disclosed. The tapered thread sections distribute and accommodate high tortional forces and ensure registered alignment of the flow conduits. Seals are provided at the interface between the multiple drill sections which simultaneously seal each of the flow conduits positioned within the interior of the drill sections. The outer casing of the drill section permits the introduction of high pressure fluid and includes a plurality of pressure-responsive plugs adapted to rupture at a predetermined pressure value thereby releasing fluid to lubricate the drill string and reduce the torque encountered during the mining operation.

9 Claims, 5 Drawing Figures

DRILL SECTION AND METHOD OF HYDRAULICALLY MINING MINERAL FORMATIONS

BACKGROUND OF THE INVENTION

The present invention relates to mineral recovery, and more particularly, to an improved drill section and method of hydraulically mining mineral deposits.

Hydraulic mining techniques have been commercially introduced which permit the mining and recovery of subterranean mineral deposits in an economical and environmentally safe manner. With specific reference to the recovery of high viscosity crude oil, such as from tar sand formation, these hydraulic mining techniques utilize a high velocity liquid which is discharged into the formation to dislodge the viscous crude oil and sand particles therefrom. The viscous crude oil, liberated from the tar and formation, forms an aqueous slurry which may be raised upward to the surface wherein the slurry may be processed by conventional systems to separate the viscous crude oil from the sand particles. Various examples of hydraulic mining tools are disclosed in the U.S. Pat. No. 3,951,457, issued to Redford, and my co-pending patent applications, Ser. No. 53,029, filed June 28, 1979, entitled "Down Hole Pump With Bottom Receptor", and Ser. No. 121,712, filed Feb. 15, 1980, entitled "Improved Hydraulic Mining Tool Apparatus".

Although such prior art hydraulic mining tools have proven to be a significant improvement over previous high viscosity crude oil recovering techniques, they all, to varying extents, possess certain structural integrity and drill shaft lubrication problems which detract from their operation efficiency. These problems become acute in the recovery of minerals from deep subterranean deposits.

The structural integrity problems in the hydraulic mining tool apparatus have typically been aggravated by the lack of an effective interconnection between the individual drill sections of the drilling string which can withstand the high structural forces developed during operation. The drill sections have typically been merely interconnected by a mating flange and bolt circle arrangement. Such connections permit communication between drill sections of plural conduits, such as a cutting jet conduit, a jet pump conduit, and an eductor slurry conduit, which must be properly aligned with similar conduits maintained within the interior of an adjacent drill section. Substantial pressure is generated by the tar sand formation falling in around the drill string during deep subterranean mining operations and substantial torque is generated during rotation of the drill string; however, such high tortional forces have heretofore resulted in intermittent shutdown of the drilling operation or, in extreme instances, has caused a complete structural failure or a twist-off of one of the individual drill sections connected by prior art bolt and flange arrangements. Intermittent discontinuance of the drilling operation significantly decreases overall operating efficiency. A twist-off condition typically results in the relatively expensive mining tool being irretrievably lost within the tar sand formation.

Further, the hydraulic mining tool apparatus of the prior art has heretofore been completely void of any means for lubricating the drill string during the drilling operation to reduce tortional forces exerted on the drill string. Thus, an operator was required to continuously monitor the torque generated during the drilling operation and discontinue the drilling operation upon confronting high torque conditions. The drilling operation has been typically sporadic and operating efficiencies have been relatively low.

Additionally, the prior art hydraulic mining apparatus has typically possessed undesirable leakage at the interconnections between the various conduits disposed within the interior of the drill sections. Such leakage causes pressure drops within the cutting jet supply, jet pump supply, and eductor return conduit which adversely affects the mining operation. Thus, there exists a substantial need for an improved drill section which provides sufficient structural integrity at its end connections to prevent twist-off during the drilling operation, lubricate the drill string to reduce the torque exerted during the drilling operation, and provides an effective seal on the multiple conduit extending through the interior of the individual drill sections.

SUMMARY OF THE PRESENT INVENTION

The present invention comprises an improved hydraulic mining drill section and an improved method of hydraulically mining mineral deposits which significantly overcomes the structural integrity, drill string lubrication, and interior conduit sealing deficiencies heretofore associated in the prior art.

Particularly, the present invention comprises an improved drill section for use in hydraulic mining applications wherein opposite ends of the drill section is provided with mating male and female tapered thread connections and the various conduits such as the jet pump conduit, cutting jet conduit, and eductor conduit are spaced within the interior of the drill section. The tapered thread sections are machined within close tolerances and include complimentary annular shoulders which ensure that when multiple drill sections are assembled to form the drill string, the adjacent annular shoulders abut one another and the individual conduits are registered in proper axial alignment. The high torque encountered during the drilling operation is distributed through the tapered thread connection interface as well as the annular shoulders of the drill sections. This synergistic arrangement has been found to substantially eliminate twist-off during the drilling operation.

The present invention additionally incorporates a novel sealing arrangement which provides an effective leak-proof seal about the jet pump, cutting jet, and eductor conduits at the interface of adjacent drill sections. Specifically, the present invention contemplates the use of a pair of gaskets which are maintained on opposite ends of each of the drill sections and positioned to receive the ends of the cutting jet, jet pump, and eductor conduits. During assembly of the adjacent drill sections onto the drill string, these gaskets contact one another and compress about each of the conduits thereby forming a liquid-tight seal simultaneously about all of the interior conduits within the drill sections. The leakage from the jet pump conduit, cutting jet conduit, and eductor conduit, which have posed severe operating deficiencies in the prior art, is thereby eliminated.

To augment the improved structural integrity and sealing benefits discussed above, the present invention additionally includes means for lubricating the drill string upon encountering high torque drilling conditions. Specifically, the outer casing of the drill section includes a plurality of soft plugs and the interior of each of the drill sections is formed to permit the application of high pressure, high volume water therein. The soft plugs are adapted to rupture in response to a predetermined liquid pressure within the interior of the drill sections, thereby permitting the high pressure liquid to be released about the periphery of the drill section and lubricate the drill string. Upon encountering high torque conditions during the drilling operation, the interior of the drill sections may be rapidly flooded with high pressure fluid, which rupture the soft plugs and lubricates the entire drill string. Thus, in contrast to the prior art hydraulic mining devices, the present invention includes automatic means for reducing the development of excessive torque on the drill string and permits substantially continuous mining operations.

DESCRIPTION OF THE DRAWINGS

These as well as other features of the present invention become more apparent upon reference to the drawings wherein.

DETAILED DESCRIPTION OF THE PREFERRED EMBODIMENT

Figure 1:
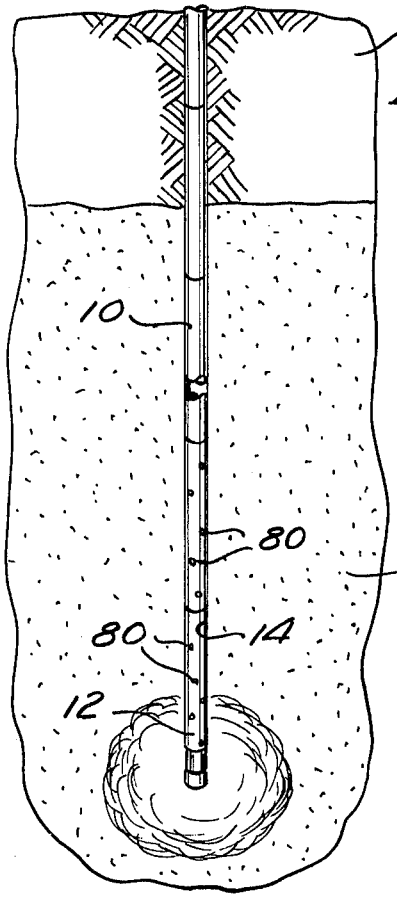
FIG. 1 is a perspective view of a drill string composed of a plurality of improved drilling sections of the present invention, disposed within a bore hole and including a hydraulic mining tool mounted at its lower end.

FIG. 1 depicts a hydraulic mining tool drill string, composed of a plurality of interconnected drill sections 10 of the present invention and mounting a hydraulic mining tool 12 at its lower end. The drill string is depicted lowered into a predrilled bore hole 14 which extends through the over-burden 16 and into a mineral deposit 18, such as a tar sand formation.

In operation, the entire drill string is rotated by conventional means from above ground surface, and a high velocity liquid, such as water, is channeled downward through the drill string and discharged radially outward through the mining tool 12 to dislodge the viscous crude oil and sand particles from the formation 18. The dislodged oil and sand particles form an aqueous slurry with the liquid discharge, which may be raised upward to the surface by way of a hydraulic jet pump disposed within the interior of the drill string. A more detailed description of the operation of such hydraulic mining tools is disclosed in U.S. Pat. No. 3,951,457, issued to Redford, and my co-pending patent applications, Ser. No. 53,029, entitled "Down Hole Pump With Bottom Receptor", and Ser. No. 121,712, entitled "Improved Hydraulic Mining Tool Apparatus", the disclosures of which are expressly incorporated herein by reference.

Figure 2:
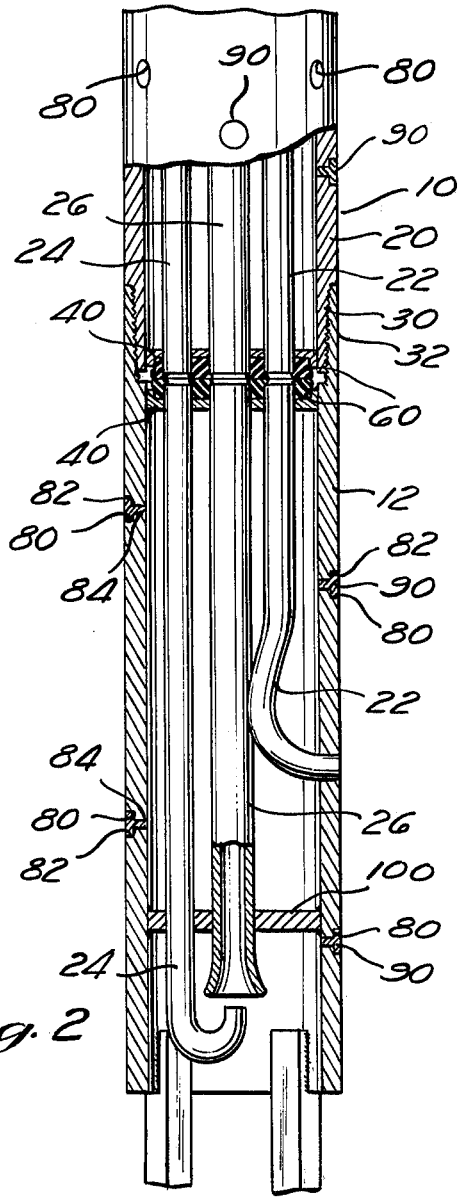
FIG. 2 is an enlarged cross-sectional view of the improved drill section of the present invention and its interconnection with a hydraulic mining tool.
Figure 4:
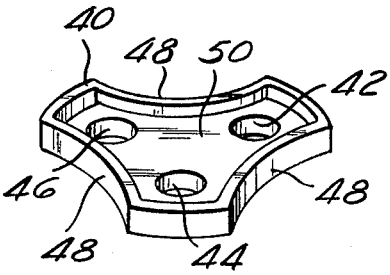
FIG. 4 is a perspective view of the conduit mounting plate which maintains the position of the conduits within the interior of the drill section.

FIG. 2 depicts the detailed construction of the improved drill section 10 of the present invention, and its particular interconnection with the mining tool 12. Although, for purposes of illustration, the structure will be defined in relation to the interconnection between the drill section 10 and the mining tool 12, it will be recognized that the same structure will be utilized for the interconnection between adjacent drill sections 10 of the drill string.

The drill section 10 is preferably formed having an outer cylindrical casing 20, the diameter of which is sized to be received within the bore hole 14 (shown in FIG. 1), preferably approximately 12 to 16 inches. Disposed within the interior of the casing 20 are a cutting jet supply conduit 22, jet pump supply conduit 24, and slurry eductor conduit 26, which, as will be described in more detail infra, are preferably symmetrically spaced and rigidly connected thereto. The lower end of the casing 20 is provided with a male tapered thread section 30, which matingly engages a complimentary shaped female tapered thread section 32 formed on the upper end of the mining tool 12 (as well as the drill sections 10). The particular pitch and configuration of the threaded sections 30 and 32 may be of any conventional manufacturing standards, but in the preferred embodiment, is formed in conformance with the Reed full-hole standard.

Figure 3:
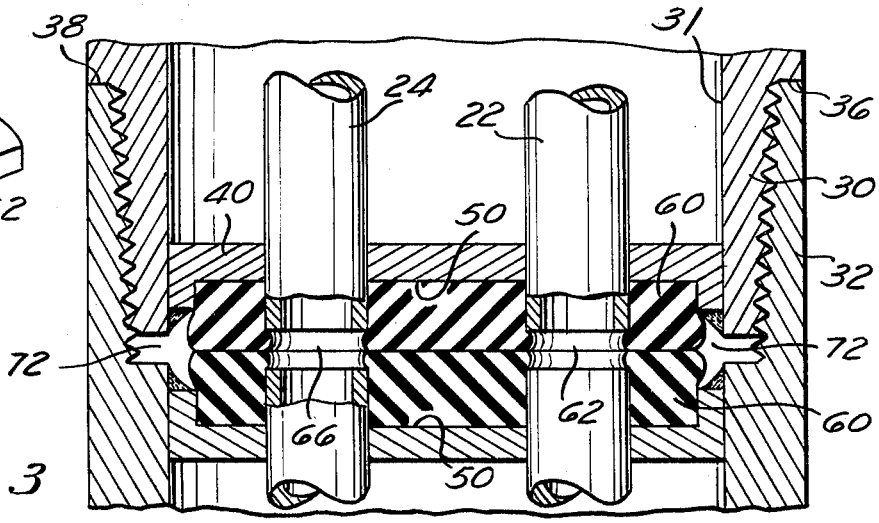
FIG. 3 is an enlarged cross-sectional view illustrating the tapered thread end connections of the improved drill section of the present invention and further indicating the resilient sealing gaskets positioned on opposite ends of the drill section.

As best shown in FIG. 3, the male and female thread sections 30 and 32 are each formed having annular shoulders 36 and 38, respectively, which are adapted to tightly abut one another and form a rigid interface between the drill section 10 and mining tool 12 when the drill section 10 is fully threaded into the mining tool 12. As previously mentioned, the cutting jet supply conduit 22, jet pump supply conduit 24, and eductor conduit 26 are rigidly maintained at precise locations within the interior of the drill section 10 by a pair of mounting plates 40 disposed adjacent opposite ends of the drill section 10. The plates 40 are formed to have an effective outside diameter sized to tightly engage the inside diameter 31 of the casing 30. The plates includes three apertures 42, 44, and 46 which are symmetrically spaced from one another and are sized to tightly receive the outside diameter of the conduits 22, 26, and 24, respectively. The plate is additionally formed having three semicircular recesses 48, formed along its perimeter which, as will be explained in more detail infra, form plural relief passages which permit the passage of supplemental water within the interior of each of the drill sections 10.

The mounting plates 40 are positioned on opposite ends of the drill section 10 and are recessed a short distance axially inward from the ends thereof whereby the distal ends of conduits 22, 24, and 26 extend through the apertures 42, 46, and 44. Positioned in such a manner, the plates 40 are rigidly affixed, as by welding, to the inside diameter 31 of the drill section 10, as well as to each of the conduits 22, 24, and 26. The conduits 22, 24, and 26 thus are maintained in a concentric aligned orientation in each of the drilling sections 10.

Figure 5:
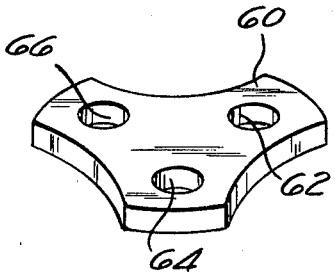
FIG. 5 is a perspective view of the resilient gasket positioned on opposite ends of the improved drilling section.

The outer-most or interfacing surfaces of each of the mounting plates 40 is provided with a spoke-shaped pocket or recess 50 which receives a complimentary shaped, relatively thick resilient gasket 60 (shown in FIG. 5). The gasket 60 is preferably formed of an elastomeric or deformable material, such as oil resistant synthetic rubber or polytetrafluoroethylene, and includes three apertures 62, 64, and 66, which are aligned with the apertures 42, 44, and 46 of the mounting plate 40 and sized to tightly receive the conduits 22, 26, and 24, respectively. As shown in FIG. 3, the gasket 60 is positioned within the recess 50 of the mounting plate 40 and extends a short distance beyond the distal ends of the conduits 22, 24, and 26 whereby the gasket 60 is prevented from rotation relative the support plate 40.

Adjacent drill sections may be assembled in an end-to-end orientation to form a drill string by threading the male tapered thread portion 30 of the upper drill section 10 into the female tapered thread portion 32 of the lower drill section 10. The length of the threaded portions 30 and 32, as well as the location of the annular shoulders 36 and 38, are maintained within high tolerances, such that when the shoulders 36 and 38 of the threaded portions 30 and 32, respectively, abut one another, the conduits 22, 24, and 26 of the upper drill section 10 are vertically aligned with the conduits 22, 24, and 26 on the lower drill string section. Thus, the shoulders 36 and 38 form a stop which limits additional relative rotation of the drill section 10 along the thread portions 30 and 32 and accurately align the conduits 22, 24, and 26.

The gaskets 60 extend a short distance beyond the ends of the conduits 22, 24, and 26 of each of the drill sections 10, and during the assembly process, abut one another along the interfacing surfaces and compress or deform axially. This compressive deformation causes the gaskets 60 to tightly engage the outside diameters of each of the conduits 22, 24, and 26, and yield a slight bulge effect or lateral expansion, as depicted in FIG. 3. An effective fluid-tight seal is formed on each of the conduits 22, 24, and 26 at the interconnection between adjacent drill sections 10. A positive high strength interconnection between adjacent drilling sections 10 is provided by the predetermined abutment relationship of the shoulders 36 and 38 which distributes the torsional forces exerted during the drilling operation along the length of the threaded portions 30 and 32, and throughout the abutment area of the annular shoulders 36 and 38.

To augment the above-described increased structural integrity, and interior conduit sealing features, the present invention additionally incorporates a novel drill string during the mining operation. The particular structure utilized for this purpose is illustrated in FIG. 2, wherein the outer casing 20 of each of the drill strings 10, and preferably the mining tool 12, is provided with a plurality of apertures 80 which extend radially through the casing 20. The apertures are preferably formed having an enlarged diameter portion 82 adjacent the outside diameter of the casing 20 and a smaller diameter portion 84 which communicates with the interior of the drill section 10. Each of the apertures 80 receives a "T"-shaped soft plug 90, preferably formed of a lead or wax material which is press-fit therein and adapted to rupture or blow-out in response to a predetermined pressure differential existing across the outer casing wall 10.

To permit the selective development of high pressure within the interior of the drill string, the mining tool 12 is preferably provided with a lower end plate 100 (shown in FIG. 2) which is located above the venturi throat or lower end of the eductor conduit 26. The plate 100 is rigidly maintained, as by welding, to the eductor conduit 26, jet pump conduit 24, and inside diameter 31 of the casing 10, and forms, in effect, a plug or leak-proof barrier at the lower-most end of the drill string. The interior region of each of the drill sections 10 and thus the entire drill string above the leak-proof barrier plate 100 may be filled with a high pressure fluid, such as water, introduced from above ground. When the pressure of the water introduced therein attains a value greater than the predetermined pressure value of the plugs 90, the plugs 90 rupture or blow-out radially into the formation 18, thereby permitting the introduced high pressure water within the interior of the drill string to flow outward throughout the length of the drill string into the mineral formation 18 and lubricate the entire bore hole 14.

During the drilling operation, the torque exerted on the drill string may be monitored by any conventional torque measuring device. When high torque conditions develop, high pressure water may be immediately introduced within the interior of the drill string. Within a short period of time, the interior of the drill string is raised to a sufficient pressure value whereupon the plugs 90 rupture and permit the high pressure water to spray radially outward through the plural apertures 80 and into the formation 18 to lubricate the entire length of the bore hole 14. With the bore hole 14 lubricated, the torque exerted on the drill string is reduced, so that the hydraulic mining operation may be continued without interruption.

In summary, the present invention comprises an improved drill section utilized in hydraulic mining apparatus which eliminates the structural integrity deficiencies, internal conduit leakage deficiencies, and high torque deficiencies, heretofore associated with the prior art. The preferred method of construction and operation of the present invention has been disclosed, but modifications can be made without departing from the spirit of the invention.

What is claimed is:

1. An improved drill string for use in hydraulic mining applications comprising:

at least two drill sections interconnected in end-to-end orientation, each of said drill sections comprising:

a cylindrical casing having an outside diameter sized to be received within a bore hole and an inside diameter defining an interior region;

plural conduits extending axially within and mounted at non-concentric predetermined positions within said interior region;

complimentary shaped threaded portions formed on opposite ends of said cylindrical casing adapted to permit said at least two drill sections to be threaded together; and stop means formed on said threaded portions for limiting the relative rotational travel of said at least two drill sections along said threaded portions, said stop means located to axially align each of said plural conduits of said at least two drill sections at said non-concentric predetermined positions when said at least two drill sections are threaded together.

2. The improved drill string of claim 1 further comprising:

means positioned adjacent said opposite ends of said cylindrical casing for forming a seal about each of said plural conduits of said at least two drill sections when said at least two drill sections are threaded together.

3. The improved drill string of claim 2 wherein said sealing means comprises:

a pair of resilient gaskets each positioned adjacent opposite ends of said at least two drill sections and cooperating with the distal ends of said plural conduits, said gaskets on each of said at least two drill sections adapted to abut one another and compress axially when said at least two drill sections are threaded together.

4. The improved drill string of claim 3 wherein said stop means comprises:

a pair of annular shoulders formed adjacent opposite ends of said at least two drill sections, said shoulders positioned relative said threaded portion to abutt one another when each of said plural conduits are aligned and said at least two drill sections are threaded together.

5. The improved drill string of claim 1 further comprising:

a plurality of apertures extending radially through said cylindrical casing; and plugs inserted in the apertures for rupturing in response to a predetermined pressure gradient existing radially across said plug means.

6. The improved drill string of claim 5 wherein said plugs comprise wax plugs press-fit within each of said plural apertures.

7. A drill section for use in hydraulically mining a subterranean mineral deposit comprising:

a tubular casing sized to be received and rotated within a bore hole;

plural conduits extending axially within the interior of said tubular casing adapted to transport liquid into said mineral deposit to form a mineral slurry and remove said mineral liquid slurry from said mineral deposit;

means formed on said tubular casing for releasing a liquid maintained within the interior of said casing in response to a predetermined pressure differential existing across said tubular casing to flow into said bore hole and lubricate said casing during rotation of said casing in said bore hole; said releasing means comprising:

a plurality of apertures extending radially through said tubular casing; and plugs inserted in said apertures for rupturing in response to sensing said predetermined pressure differential.

8. An improved method of hydraulically mining a mineral deposit comprising the steps of:

rotating a tubular drill string within a bore hole formed in a mineral formation;

transporting liquid through said drill string into said mineral formation to form a mineral liquid slurry;

removing said mineral liquid slurry from said mineral formation to ground surface through said drill string;

monitoring the torque exerted on said drill string during rotation of said drill string;

introducing a liquid to flood the interior of said tubular drill string when said torque exerted on said drill string is at a predetermined maximum value; and releasing said liquid through a pressure-responsive means formed on said drill string to lubricate said drill string within said bore hole and reduce said torque exerted on said drill string.

9. The improved method of claim 8 wherein said pressure-responsive means comprises a plurality of plugs press-fit into mating apertures extending radially through said drill string and said method comprising the further step of:

raising the pressure of said introduced liquid to a predetermined value sufficient to rupture said plural plugs.

* * * * *